United States Patent [19]

Lucas

[11] Patent Number: 4,757,841

[45] Date of Patent: Jul. 19, 1988

[54] SPOUT WITH READILY SERVICEABLE FLOW CONTROL

[75] Inventor: Donald A. Lucas, Lafayette, Ind.

[73] Assignee: Globe Valve Corporation, Delphi, Ind.

[21] Appl. No.: 55,374

[22] Filed: May 29, 1987

[51] Int. Cl.[4] ..... E03C 1/04

[52] U.S. Cl. ..... 137/801; 138/44; 239/590.3

[58] Field of Search ..... 137/801; 138/40, 44, 138/45, 46; 239/590.3, 590.5, 553.3, 553.5; 4/192

[56] References Cited

U.S. PATENT DOCUMENTS

| | | | |
|---|---|---|---|
| D. 278,270 | 4/1985 | Niemann . | |
| D. 278,271 | 4/1985 | Niemann . | |
| D. 279,123 | 6/1985 | Niemann . | |
| 1,609,022 | 11/1926 | Hoke | 138/40 |
| 1,854,796 | 4/1932 | Kersten | 137/801 |
| 1,921,827 | 8/1933 | Kersten | 138/46 X |
| 2,007,036 | 7/1935 | Cornell | 138/44 |
| 2,009,607 | 7/1935 | Dobrick | 138/44 X |
| 2,072,556 | 3/1937 | Hibner | 138/46 |
| 2,887,275 | 5/1959 | Dixon et al. | 239/590.3 X |
| 3,143,299 | 8/1964 | Benjamin | 239/590.3 X |
| 3,374,957 | 3/1968 | Tyler | 4/192 X |
| 4,624,415 | 11/1986 | Hoffstetter | 138/40 X |

FOREIGN PATENT DOCUMENTS

| | | | |
|---|---|---|---|
| 1110292 | 4/1968 | United Kingdom | 138/46 |

*Primary Examiner*—Gerald A. Michalsky

*Attorney, Agent, or Firm*—Dressler, Goldsmith, Shore, Sutker & Milnamow, Ltd.

[57] ABSTRACT

A spout assembly is provided with a discharge conduit defining a flow passage having an inlet and an outlet. The conduit has a unitary internal wall defining an aperture and a shoulder around the aperture upon which is disposed a foraminous, flow restricting member. The flow restricting member is held in position against the shoulder by a plug which is threadingly engaged with the discharge conduit in an access opening spaced from, but aligned with, the internal wall shoulder.

6 Claims, 1 Drawing Sheet

FIG. 1
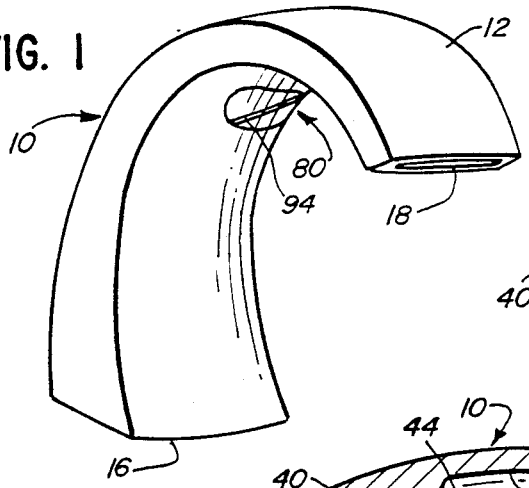
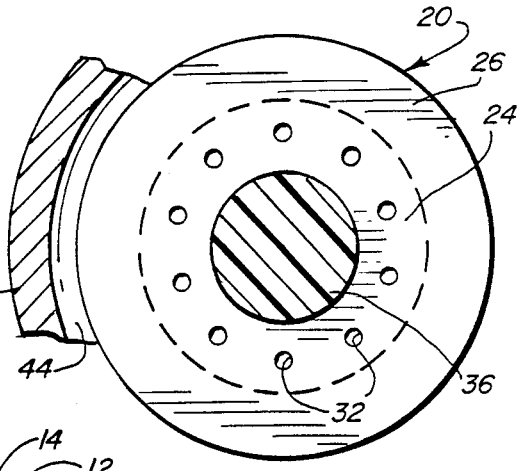
FIG. 4
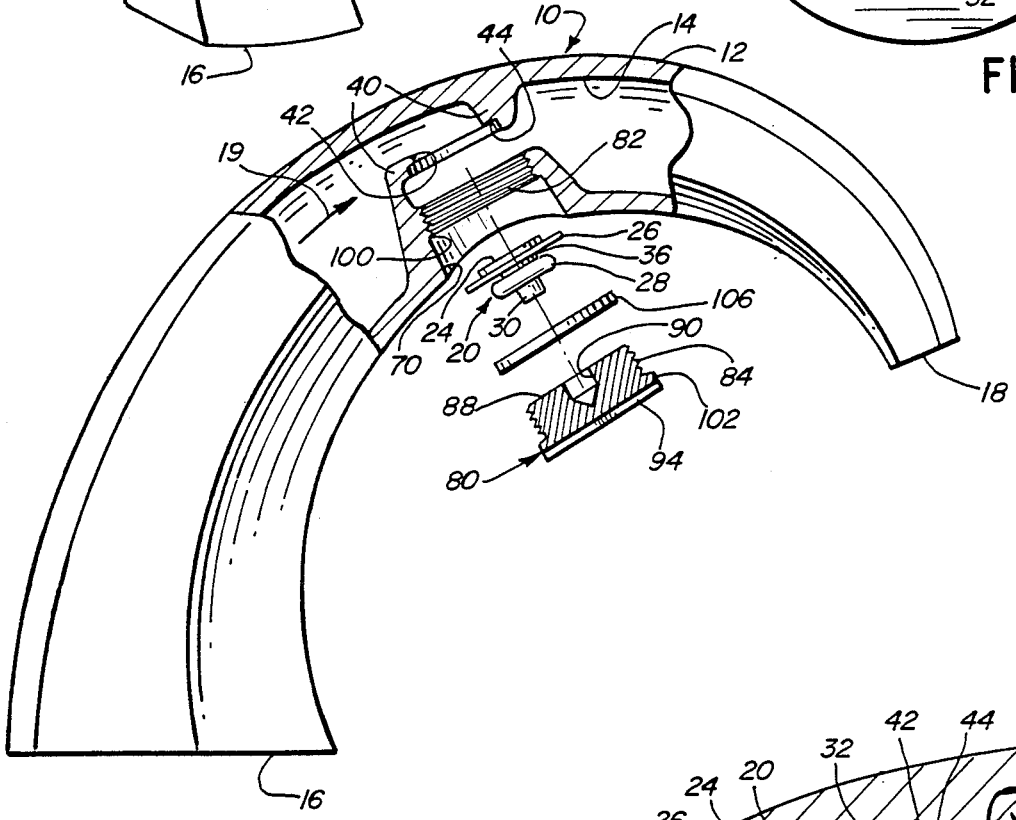
FIG. 2
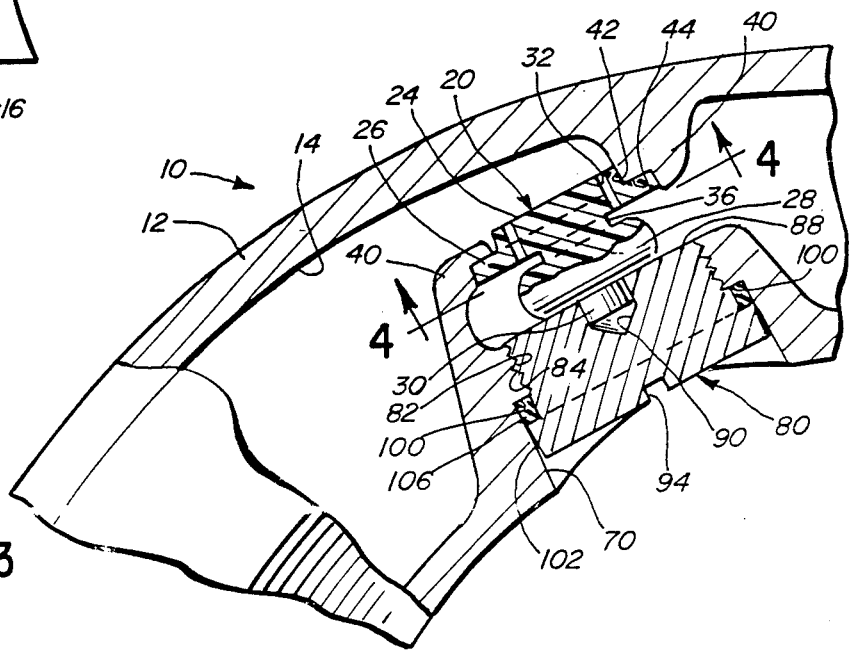
FIG. 3

SPOUT WITH READILY SERVICEABLE FLOW CONTROL

TECHNICAL FIELD

This invention relates to a discharge spout assembly for providing reduced flow, and the invention is especially suitable for use with faucet spouts provided on household sinks.

BACKGROUND OF THE INVENTION AND TECHNICAL PROBLEMS POSED BY THE PRIOR ART

Conventional plumbing fixtures, especially faucet spouts, are designed with internal flow passages which are large enough to be easily manufactured and to provide sufficient "excess" flow capacity as may be needed for certain uses. Further, a sufficiently large flow passage throughout the spout length reduces the probability of the spout plugging up over the years owing to internal deposition of dirt, scale, and the like.

Usually, the excess flow capacity of a spout is not initially required when the spout is new and free of internal dirt and scale deposition. Further, such excess flow capacity is not required for many normal uses. Thus, in typical installations, it may be desirable to have a "built-in" reduction in the flow rate capacity that functions continuously and independently of any valve control. This may be desirable where, for example, children or other people may routinely open a faucet valve to its maximum, wide-open, position even though the resulting maximum flow rate is excessive and wasteful.

Accordingly, it would be beneficial to provide a means for controlling (and especially, reducing) flow through a spout on a continuous basis in a manner that does not require, or even permit, routine adjustment by the user.

Some types of approaches to designing bathrooms, spas, and other facilities in which water discharge spouts are employed have as one of their objectives the creation of a sleek, clean-lined appearance. The desired sleek appearance typically extends to fixtures, including water discharge spouts. With such design approaches, there is a need to provide discharge spouts that have aesthetically pleasing configurations and surfaces which show no, or very few, mechanical elements or features that would interrupt the design and create a negative visual impact. Thus, it would be advantageous to provide a spout with the above-described flow control feature in a way that would eliminate or reduce the visual impact of such a feature on the overall spout design.

Notwithstanding the desirability of "hiding" a flow control feature on a spout, it would also be advantageous to include such a feature in a manner such that the flow control components would be readily accessible for service from time to time. Such service may be needed to clean, repair, or replace the flow control components.

SUMMARY OF THE INVENTION

A spout assembly is provided with a discharge conduit defining a flow passage having an inlet and an outlet. The assembly includes a flow restricting means for restricting the flow of fluid through the passage. A receiving means is provided for receiving the flow restricting means in a predetermined position in the passage between the inlet and the outlet. Finally, an access means is provided in the conduit for accommodating insertion and removal of the flow restricting means relative to the conduit means.

In the preferred embodiment, the flow restricting means includes a foraminous member, the receiving means includes a wall integrally formed in the conduit to define an aperture across which the flow restricting means is disposed, and the access means includes a threaded opening in the conduit and a threaded plug for occluding the opening.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a perspective view of the spout assembly of the present invention;

FIG. 2 is an enlarged, partial cross-sectional exploded view of the assembly;

FIG. 3 is a more greatly enlarged, fragmentary, partial cross-sectional view of the assembly with the components assembled in the normal operating position; and FIG. 4 is a fragmentary, cross-sectional view taken generally along the plane 4—4 in FIG. 3.

DESCRIPTION OF THE PREFERRED EMBODIMENT

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

The spout assembly of the present invention is illustrated in FIG. 1 and is designated generally therein by the reference numeral 10. As best illustrated in FIGS. 1 and 2, the assembly 10 includes a discharge conduit 12 which is typically fabricated from a suitable material, such as brass. Other materials may be employed. The discharge conduit 12 defines an internal flow passage 14 which has an inlet 16 and an outlet 18. The flow through the discharge conduit 12 occurs in the direction indicated by the arrow 19 in FIG. 2.

A flow restricting means or control means 20 (FIGS. 2, 3, and 4) is provided for restricting flow of fluid through the passage 14 in the discharge conduit 12. Preferably, the flow restricting means 20 is a foraminous member, and in the embodiment illustrated, the flow restricting means 20 is a conventional aerator device having a central disc 24, a flange 26, a bearing member 28, and a cylindrical end portion or projection 30.

The disc 24 includes a plurality of circumferentially spaced orifices 32 which are arranged in a circular pattern in the disc 24. The bearing member 28 is connected to the disc 24 by means of a reduced diameter neck portion 36 so as to provide clearance around the orifices 32.

The spout assembly 10 includes a receiving means for receiving the flow restricting means 20 in a predetermined position in the passage 14 between the inlet 16 and outlet 18, and the receiving means, in the preferred embodiment illustrated in FIGS. 2 and 3, includes an internal wall 40 which is unitary with the discharge conduit 14 and which defines an aperture 42 (FIG. 2) for receiving part of the flow restricting means 20. Preferably, the aperture 42 is circular, and the internal wall 40 further defines an annular shoulder 44 around the aperture 42 for receiving the flange 26 of the flow restricting means 20.

When the flow restricting means 20 is positioned across the aperture 42 in the internal wall 40 (as best illustrated in FIG. 3), the total cross-sectional flow passage area provided by the orifices 32 is less than the total cross-sectional flow area of the aperture 42. Thus, the flow through the discharge conduit 12 is restricted, and to that extent, controlled.

An access means is provided in the discharge conduit 12 for accommodating insertion and removal of the flow restricting means 20. The access means includes an opening 70 in the conduit 12 and a plug 80. Preferably, the access opening 70 is circular or cylindrical and has a threaded inner portion 82. Similarly, the plug 80 is preferably generally cylindrical and has a threaded portion 84 for threadingly engaging the threaded portion 82 of the discharge conduit 12 at the access opening 70. To aid in screwing and unscrewing the plug 80, a slot 94 is provided in the exterior surface of the plug 80.

Further, the plug 80 preferably includes an inner end surface 88 for engaging a portion of the flow restricting means 20. As best illustrated in FIG. 3, the plug inner end surface 88 engages the outwardly facing surface of the flow restricting means bearing member 28. The plug 88 thus urges the flow restricting member means 20 against the annular shoulder 44 in the internal wall 40. It will be noted that the plug 80 further defines a cavity 90 in the end surface 88, and the cavity 90 opens toward the flow restricting means 20 for receiving the cylindrical end portion 30.

Preferably, to ensure that the assembly is leak tight, the conduit 12 defines an annular seat 100 around the access opening 70, and the plug 80 is provided with an annular flange 102. The assembly includes a washer 106 which is disposed between the conduit annular seat 100 and the plug annular flange 102.

To initially assemble the components, the flow restricting means 20 is first positioned on the plug 80 with the cylindrical end portion 30 received in the plug cavity 90. Preferably, thick grease is initially deposited in the plug cavity 90 before the cylindrical end portion 30 of the flow restricting means 20 is positioned in the cavity 90.

Next, the washer 106 is positioned on the flange 102 of the plug 80. Alternatively, the washer 106 may be installed on the plug 80 before the flow restricting means 20 is mounted on the plug 80.

Subsequently, the subassembly of the flow restricting means 20, washer 106, and plug 80 are inserted together into the access opening 70. The plug 80 is then threadingly engaged with the discharge conduit threads 82 and is tightened until the flow restricting means 20 is properly positioned tight against the annular shoulder 44 of the conduit internal wall 40. The washer 106 has sufficient thickness and resiliency to be compressively engaged between the discharge conduit annular seat 100 and the plug flange 102 so as to provide a leak-tight seal.

When the plug 80 is properly installed as illustrated in FIG. 3, the exterior end surface of the plug 80 is either flush with, or slightly recessed below, the surrounding exterior surface of the discharge conduit 12.

Preferably, as best illustrated in FIGS. 1–3, the access opening 70 and plug 80 are installed in an undersurface or underside of the discharge conduit 12 which, as illustrated, is generally arcuate or curved. This generally hides the exterior end surface of the plug 80 from the view of a routine user of the discharge conduit 12. This is because the discharge conduit 12 is normally mounted to a sink at an elevation where the undersurface of the discharge conduit 12 is not normally visible from a position above the sink. Of course, the spout assembly of the present invention may be used in lavatories, tubs, and sinks.

Notwithstanding the fact that the plug 80 is not easily visible when installed, access to the plug 80 can be had with relative ease. The plug 80 is easily unthreaded to permit access to the interior components for service (which may include cleaning, adjustment, repair, removal, or replacement).

Although the flow restricting means 20 has been illustrated as a conventional aerator device, other configurations may be employed. For example, the orifices 32 may have other shapes, may be arranged differently, and may have different cross-sectional flow areas. Further, other flow restricting elements, apart from orifices per se, may be employed in a suitable structure in the conduit 12.

It will be readily observed from the foregoing detailed description of the invention and from the illustrated embodiment thereof that numerous variations and modifications may be effected without departing from the true spirit and scope of the novel concepts or principles of this invention.

What is claimed is:

1. A spout assembly for a water faucet having a hot and cold water valve assembly and a common outlet conduit, said spout assembly comprising a discharge conduit having a peripheral wall defining an internal flow passage having an inlet and an outlet, said dicharge conduit being adapted to be connected at its inlet with said common outlet conduit of said hot and cold water valve assembly, said discharge conduit extending upwardly and downwardly in an arc between said inlet and outlet with said discharge conduit peripheral wall including an exterior surface facing generally downwardly at a location above said inlet and outlet when the spout assembly is installed as part of said water faucet, said discahrge conduit further including an internal wall extending across said internal flow passage, said internal wall being spaced inwardly from said discharge conduit inlet and outlet, said internal wall defining an aperture through said internal wall, said internal wall further defining an annular shoulder around said aperture, said downwardly facing exterior surface and said discharge conduit peripheral wall further defining an access opening into said flow passage adjacent said internal wall, said access opening being spaced from, but aligned with, said aperture and shoulder, said discharge conduit peripheral wall defining threads around said access opening;

a flow restricting member disposed across said aperture in said internal wall, said flow restricting member including (1) an annular flange for being received by said annular shoulder, (2) a bearing member on one side of said flange, (3) a cylindrical projection extending axially outwardly from said bearing member, and (4) means for restricting flow through said aperture; and a removable plug disposed in said discharge conduit access opening, said plug defining threads for engaging said discharge conduit threads around said access opening, said plug defining an annular end surface for engaging a peripheral portion of said bearing member to urge said flow restricting member against said annular shoulder in said internal wall, said annular end surface defining a central cavity opening toward said flow restricting member to receive said flow restricting member cylindrical projection to aid in installing and aligning said plug and said flow restricting member in said spout assembly and to retain said flow restricting member in a predetermined position relative to said plug.

2. The spout assembly in accordance with claim 1 in which said internal wall is unitary with said discharge conduit.

3. The spout assembly in accordance with claim 1 in which said flow restricting member defines a plurality of flow orifices disposed in a circular array.

4. The spout assembly in accordance with claim 1 in which said plug includes an annular flange and in which said discharge conduit defines an annular seat around said access opening for receiving said plug annular flange.

5. The spout assembly in accordance with claim 4 in which said assembly further includes a washer disposed between said plug annular flange and said discharge conduit annular seat.

6. The spout assembly in accordance with claim 1 in which said internal wall is unitary with said discharge conduit peripheral wall.

* * * * *